US005331696A

United States Patent [19]

Armstrong et al.

[11] Patent Number: 5,331,696

[45] Date of Patent: * Jul. 26, 1994

[54] REMOVABLE COVERS FOR WATERBED RAILS

[76] Inventors: Mark A. Armstrong, 9605 W. Hwy. 90 Lot No. #235, San Antonio, Tex. 78235-9535; Joel K. Harper, Rte. 4, Box 285, Lubbock, Tex. 79423

[ * ] Notice: The portion of the term of this patent subsequent to Nov. 17, 2009 has been disclaimed.

[21] Appl. No.: 977,582

[22] Filed: Jan. 13, 1993

Related U.S. Application Data

[63] Continuation-in-part of Ser. No. 872,543, Apr. 23, 1992, Pat. No. 5,163,197.

[51] Int. Cl.[5] ..... A47G 9/00; A47C 21/00; A47C 31/00

[52] U.S. Cl. ..... 5/451; 5/663

[58] Field of Search ..... 5/451, 450, 422, 400, 5/663, 424, 917, 482, 922, 923; 248/345.1

[56] References Cited

U.S. PATENT DOCUMENTS

| | | | |
|---|---|---|---|
| 3,546,725 | 12/1970 | Tambascio | 5/907 |
| 4,089,497 | 5/1978 | Miller et al. | 5/663 |
| 4,103,375 | 8/1978 | Santo | 5/201 |
| 4,109,887 | 8/1978 | Wakeland, Jr. | 5/663 |
| 4,228,555 | 10/1980 | Katzakian | 5/498 |
| 4,514,871 | 5/1985 | Fisher et al. | 5/451 |
| 4,521,970 | 6/1985 | Jester | 5/398 |
| 4,637,082 | 1/1987 | Moore et al. | 5/452 |
| 4,675,928 | 6/1987 | Fisher et al. | 5/400 |
| 4,703,531 | 11/1987 | Bisset | 5/663 |
| 4,841,586 | 6/1989 | Juster et al. | 5/181 |
| 4,862,543 | 9/1989 | Falwell et al. | 5/663 |
| 4,878,259 | 11/1989 | Lupo | 5/451 |
| 5,081,725 | 1/1992 | Neese | 5/424 |

*Primary Examiner*—Alexander Grosz
*Attorney, Agent, or Firm*—Gunn, Lee & Miller

[57] ABSTRACT

A cover for removably attaching to paddled waterbed rails. Specifically, a cover having a variety of devices for joining a series of paired straps attached along opposite edges of the cover to secure the cover to the waterbed rail.

18 Claims, 5 Drawing Sheets

REMOVABLE COVERS FOR WATERBED RAILS

This is a continuation-in-part of U.S. patent application Ser. No. 07/872,543 filed Apr. 23, 1992, now U.S. Pat. No. 5,163,197.

FIELD OF THE INVENTION

Removable fabric covers for padded waterbed rails, more specifically, foldable, rollable, washable, reversible slip-on covers for the padded rails of waterbeds.

BACKGROUND

Waterbeds are comprised of a rectangular wooden box called a pedestal which is supported by the floor. The pedestal can be made of veneer, oak or other wood and may or may not be stained or painted. Frequently, the pedestal is made of particle board. Resting on the pedestal and overlapping the pedestal by six inches to one foot is a decking. The decking is rectangular, made of ⅜-inch to ½-inch thick wood and is 4 foot by 7 foot (Super Single), 5 foot by 7 foot (Queen), or 6 foot by 7 foot (King). Fastened to the decking and extending vertically upward is the frame of the waterbed. The frame is designed to enclose the water-filled liner. The frame is usually comprised of two side walls made of ¾ inch to 1¾ inch hardwood. In addition, the frame is comprised of either a foot board and a head board or end boards dimensioned similarly to the side boards.

Most waterbed flames have a top perimeter which is fitted with removable padded rails. Rails are required for comfort. The compliant nature of the flexible water-filled mattress causes it to collapse under the weight of an occupant seated on the edge of the waterbed. The occupant, sitting on the edge of a waterbed without rails will have the top perimeter of the unpadded side rails dig into his thighs. This causes a substantial discomfort. Thus, the necessity for providing a thick, padded side rail. Indeed, 95% of the waterbeds sold today have removable padded side rails and, in some cases, padded end walls and/or head boards as well.

The padded rails are designed to compression fit onto the top of the side walls and/or the foot boards of the waterbed. The padded rails are constructed of three main parts. The foundation of a padded rail is comprised of three sections of wood joined in perpendicular relation to form either an inverted U- or an inverted J-shaped base. The inside width of the inverted U- or J-shaped base is approximately equal to the thickness of the top perimeter of the frame of the waterbed, allowing a slightly compressive "press" fit to the perimeter walls of the frame. The outside surface of the U- or J-brace (known in the trade as a "regular" rail or a super (executive) rail, respectively), is a thick sheet of foam. Covering the foam and permanently tacked or stapled to the base of the padded rail is a permanently fixed rail skin usually made of vinyl or velvet. Thus, the regular or super rails are permanently covered with a permanently attached skin and slip onto the top perimeter of the frame to provide comfort for the consumer.

The sales of waterbeds in the United States is presently over One Billion Dollars per year and growing. From their inception about twenty years ago they have come to represent a substantial portion in the retail home furnishing market. Nonetheless, as a new product, not unexpectedly, new and unique problems with waterbeds have developed. As a result, waterbeds, as well as parts and accessories for waterbeds, have been the subject of numerous patents.

These patents identify and address problems regarding the structure of waterbeds themselves as well as decorative aspects of waterbeds. The device of the present invention relates to waterbeds, specifically, to a cover for the padded rails of the waterbeds. Such rails have been the subject of a number of United States patents including the following:

| U.S. Pat. No. | INVENTOR | DATE ISSUED |
|---|---|---|
| 4,109,887 | Wakeland, Jr. | August 29, 1978 |
| 3,546,725 | Tambascio | December 15, 1970 |
| 4,103,375 | Santo | August 1, 1978 |
| 4,878,259 | Lupo | November 7, 1989 |
| 4,514,871 | Fisher et al. | May 7, 1985 |
| 4,637,082 | Moore et al. | January 20, 1987 |
| 4,675,928 | Fisher et al. | June 30, 1987 |
| 5,703,531 | Bissett | November 3, 1987 |
| 4,841,586 | Juster et al. | June 27, 1989 |

U.S. Pat. No. 4,109,887 (Wakeland, Jr. 1978) discloses a rail cap for a waterbed frame comprised of a U-shaped foam structure. More specifically, FIG. 6 of the Wakeland reference discloses a covering on the U-shaped foam member.

U.S. Pat. No. 3,546,725 (Tambascio 1970) discloses a removable U-shaped member for decorating the side rails of a bed frame. The decorative strip may be snap-fastened over the railing and extends below the railing to completely cover it.

U.S. Pat. No. 4,103,375 (Santo 1978) discloses a modular waterbed frame having a resilient cap to fit over the side rails.

U.S. Pat. No. 4,878,259 (Lupo 1989) discloses a one-piece decorative wrap designed to removably cover the pedestal to a waterbed mattress. The Lupo wrap discloses the use of Velcro TM type fasteners and the use of self-stick tape to hold the wrap to the pedestal.

U.S. Pat. No. 4,514,871 (Fisher et al. 1985) discloses an outer covering fabric (25) typically of naugahyde or similar vinyl plastic material stitched to an inner rigid frame that provides for joining a supplementary end rail to waterbed side rails in a smooth, decorative and functional corner joint and seal.

U.S. Pat. No. 4,637,082 (Moore et al. 1987) discloses a waterbed having a resilient cushion made up of slings that lay in the frame, such that the water-filled liner holds the peripheral cushions around the perimeter.

U.S. Pat. No. 4,675,928 (Fisher et al. 1987) is a continuation the '871 patent discussed above, disclosing the same subject matter.

U.S. Pat. No. 4,703,531 (Bissett 1987) discloses a padded rail comprised of foam, blocks of wood, and a fabric covering the foam, the fabric which is stapled to the wood.

U.S. Pat. No. 4,841,586 (Juster et al. 1989) discloses a frame for a waterbed that is adjustable in size, allowing a single frame to be used for a queen- or king-size bed.

In addition, U.S. Pat. No. 4,878,259, while not relating to padded rails, does relate to a waterbed pedestal wrap that is removably attached to the rectangular pedestal base of the waterbed frame. The decorative one-piece wrapping is easily installed by unrolling the wrap and fastening it to the sides of the pedestal by Velcro TM hook and loop fasteners or other convenient fastener means.

Thus, there have been a number of devices that provide for improved padded rails or decorative accessories to waterbeds. None of the inventions, however, have provided for a fabric rail cover that is removable and foldable so it may be changed, washed, or, replaced, just as are the sheets and bedspreads of the waterbed itself.

The device of the present invention provides for a cover which will slip over the padded rails to provide the customer with a wide array of choices to mix and match with his or her home bedroom decor. Applicants' removable rail covers are reversible as well as washable. These two features are provided to increase the life of the product as well as to provide the customer with two choices of decorative fabrics in one set of covers.

The covers of the present invention are manufactured out of almost any material-cotton, vinyl and leather among the choices. One of the benefits and features of the removable covers of the present invention is that they are available in a wide variety of colors and designer patterns. The covers are easily and quickly installed without tools or permanent fasteners and will fit most standard padded rails: Super Single, King, Queen, two-way, three-way, and five-way. In addition, the removable covers of the present invention reduce frame damage and damage to the permanent covers of the padded rails. Also, they represent an inexpensive alternative to rail replacement for a customer with permanently damaged or stained padded rails. The covers of the present invention may be specialized for children's rooms, for schools, for colleges with logos, and the like.

Heretofore, those customers desiring padded rails with more than one style cover have had to order several sets of rails, each with the permanently attached desired cover. This required storing the bulky, unused rails when they were not in use. If, as is often the case, a customer had more than one bedspread/sheet combination, the rails would often need to be special ordered with covers permanently attached to the rails, covers that reflected the particular bedspread/sheet combination. Even special orders are presently only available in solid colors. Ordering several sets of rails is expensive and requires a three- to six-week wait. Thus, there has been a need for a device with the qualities of applicant's invention, namely for a removable cover for waterbed rails that will provide the customer with an endless array of choices to mix and match according to his particular tastes.

SUMMARY OF THE INVENTION

It is the purpose of the present invention to provide for a removable fabric cover to a padded rail for a waterbed.

It is a further purpose of the present invention to provide for a removable fabric cover for a padded waterbed rail that is foldable, rollable, and washable.

It is a further object of the present invention to provide for a removable cover for a padded water rail that is reversible.

It is a further object of the present invention to provide for a removable foldable, rollable, washable and reversible cover for a padded waterbed rail that is dimensioned to conform to the outer surface of the padded rail and has elastic bands to hold it snug against the padded rail.

It is a further object of the present invention to provide a removable cover for padded rails of a waterbed, the removable covers coming in a single size that can fit because of the use of elastic bands, fit padded rails of a variety of thicknesses and widths.

This and other purposes are fulfilled by providing a flexible cover or wrap dimensioned to substantially cover a padded rail fitable to the top edge of a frame of a waterbed, the flexible cover having integral fastening means capable of removably securing the cover wraps snugly to the outer surface of the padded rail.

DETAILED DESCRIPTION OF THE PREFERRED EMBODIMENT

Figure 1:
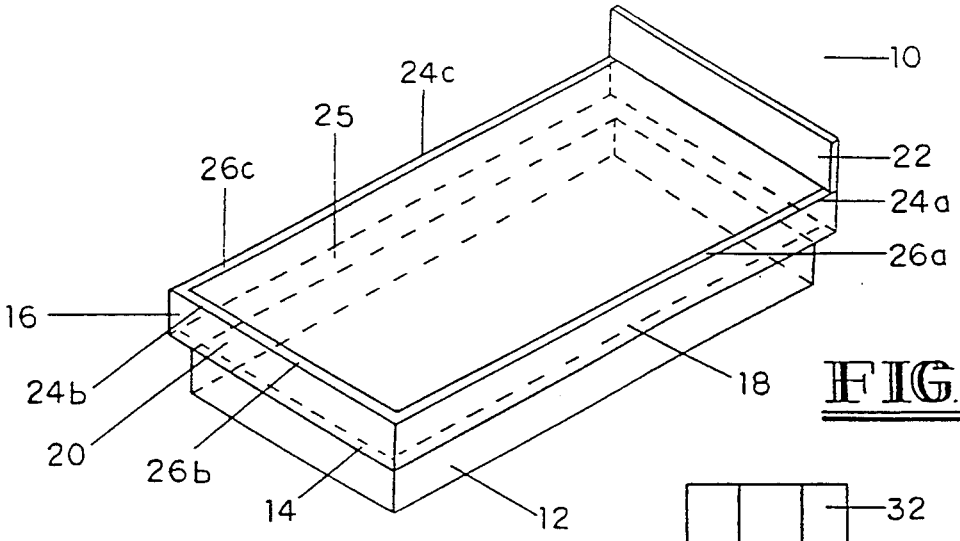
FIG. 1 is a perspective view of a waterbed showing the main components thereof.

FIG. 1 is an illustration of a perspective view of a waterbed (10). Waterbed (10) is seen to have a rectangular wooden pedestal (12) supported on the floor. Resting on pedestal (12) is a decking (14). The decking extends beyond pedestal (12). Projecting vertically from the borders of decking (14) is a frame (16). Frame (16) is comprised of two side walls (18), a foot board (20) and a head board (22).

Frame (16) is seen to have top edge (24*a*), (24*b*) and (24*c*) representing the upper portions of side walls (18) and foot board (20). Likewise, frame (16) is seen to have perimeter portions (26*a*), (26*b*) and (26*c*). A mattress liner (25), generally filled with water, is contained within frame (16).

Figure 2A:
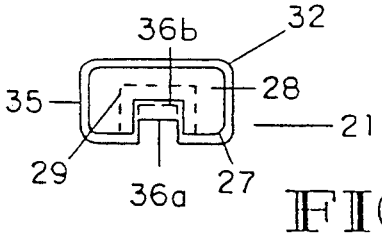
FIG. 2*a* is an elevational cutaway view from the end of a regular padded rail with the cover of Applicants' invention thereon.
Figure 2B:
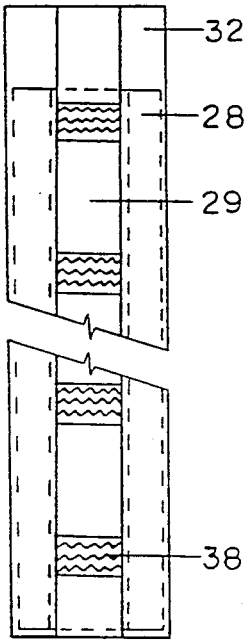
FIG. 2*b* is an elevational view from the underside of a regular padded rail with the cover of Applicants' invention thereon.

Turning now to FIGS. 2*a* and 2*b*, the figures illustrate side rails (21) having an inverted U-shaped cross-section adapted to fit over perimeter (26) and cover top edge (24). As can be seen in FIGS. 2*a* and 2*b*, padded rail (21) is comprised of a skin (27) usually made of vinyl or velvet covering a thick foam pad (28) which is built over wooden base (29). Padded rail (21) is seen to be dimensioned to slide on with a slight compression fit over top edge (24). In addition, skin (27) of padded rail (21) is stretched over foam (28) and permanently tacked, glued or stapled to base (29) along the inside surface thereof.

As can be seen in FIGS. 2*a* and 2*b*, Applicants provide cover (32) made of sheet (35) and elastic band (36)-unstretched (36*a*), stretched (36*b*).

Figure 3A:
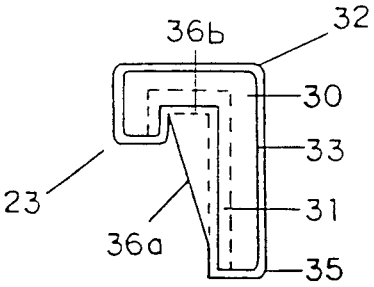
FIG. 3*a* is an elevational cutaway view from the end of a super or an executive padded rail showing the cover of Applicants' invention thereon.
Figure 3B:
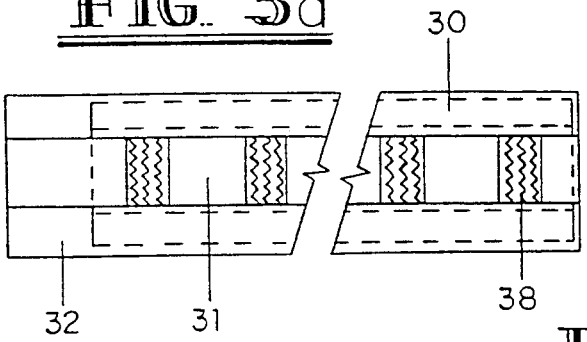
FIG. 3*b* is an elevational view from the underside of a super or an executive padded rail showing the cover of Applicants' invention thereon.

FIGS. 3*a* and 3*b* illustrate cover (32) dimensioned to fit super or executive padded rail (23). Super or executive padded rail (23) differs from regular padded rail (21) in having an inverted J-shape. Thus, super or executive padded rail (23) has a wooden base (31) covered by foam (30) with skin (33) permanently attached to base (31) and providing an outer surface to the rail. The difference between the two types of rails is in the dimensions; both will fit snugly onto top edge (24), but the executive rail will give a different appearance having the leg of the "J" on the outside surface of frame (16) and providing for more stability to the rail.

Nonetheless, as can be seen in FIGS. 2*a*, 2*b*, 3*a*, and 3*b*, Applicants' cover (32) provides for sheet (35) dimensioned to cover completely the outer surface of the rail skin and partially up the inside surface of base (29) or (31), respectively. Elastic bands (36*a*) and (36*b*), normally 1 inch by 2 inches (regular padded rail) or 1 inch by 4 inches (super executive rail) are designed such that in the unstretched position they will intercept top edge (24) and perimeter (26) while the padded rail is being press fitted to frame (16), and will stretch to positions illustrated in (36*b*) (FIGS. 2*a* and 2*b*), and thus will hold sheet (35) snugly to the surface of skin (27) or (33) and provide a pleasing decorative finish to waterbed (10).

As can appreciated in FIGS. 2*b* and 3*b*, there will be some overlap for covers (32) beyond the length of rails (21) and (23). Thus, side rails which run normally 7 feet long will have about 6 inches of excessive material on either end to tuck in to provide for a clean fit at either end of side walls (18). If the bed has a foot board with a top edge (26*b*), it will be generally between 4 feet (Super Single), 5 feet (Queen), or 6 feet (King) in length. Thus, covers (34) will extend between 5 feet and 8 feet in length. In addition, it must be remembered that when a foot board is used which may be fitted with a padded rail, along with padded rails on side boards, the ends of the padded rails that meet at the foot boards/side wall junction are mitered to provide a strong, attractive fit. Thus, additional fabric of 6 inches to 1 foot in length may be required.

Figure 4:
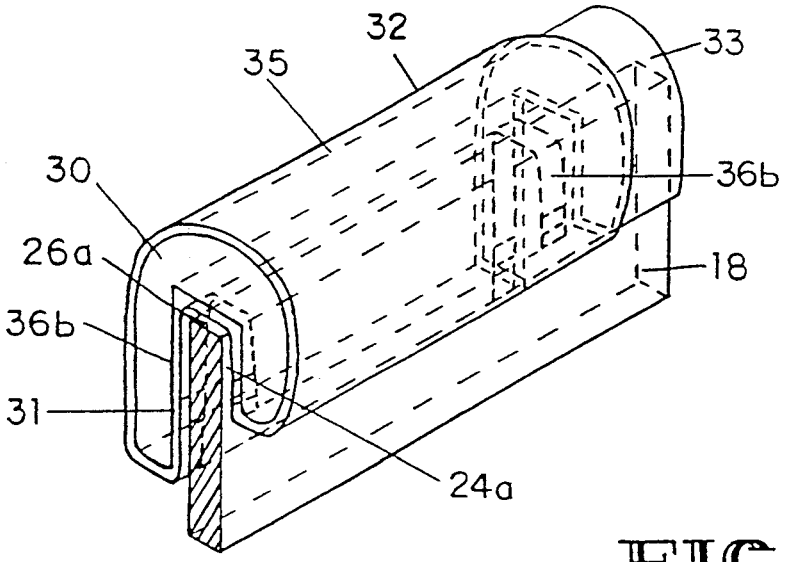
FIG. 4 is a perspective view of a super or an executive padded rail showing Applicants' cover thereon.

FIG. 4 illustrates use of cover (32) on side wall (18) of the waterbed. Note how fabric (35) completely covers skin (33) and climbs partly up the inside surface of base (31) when the covered padded rail is pressed onto top edge (24*a*) to cover perimeter portion (26*a*). Note that the leg of the inverted "J" is on the outside of side wall (18). While FIG. 4, for clarity of illustration, shows a space between inside surface of base (31) and top edge (24*a*) and perimeter portion (26*a*), in practice they will be a tight, flush fit gripping all of the elastic bands and a portion of the fabric of the cover there-between.

Figure 5:
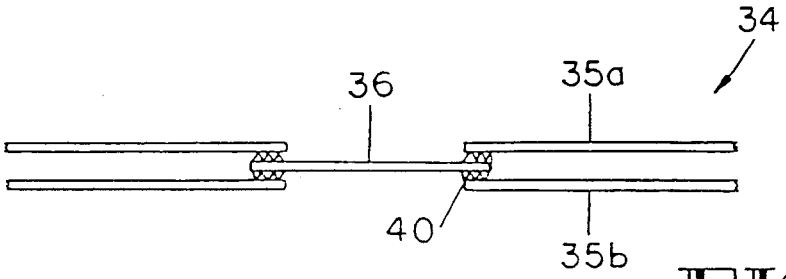
FIG. 5 is a partial cross-sectional view of two sheets sewed together at an elastic band to provide for a reversible cover.

FIG. 5 illustrates an alternative preferred embodiment of the present invention in which two machine-washable fabric members (35*a*) and (35*b*) are used to make up sheet (35). Seam (40) illustrates the manner in which elastic tape (36) is sown between (35*a*) and (35*b*). As can be appreciated from FIG. 5, the two-sided (reversible) embodiment of the present invention could have one of the two fabric members as a solid color and the other member as a print. This allows the consumer a degree of variety in their bed sheet and bedroom decor. Note that the cover is reversible simply by pulling it inside out.

Figure 6:
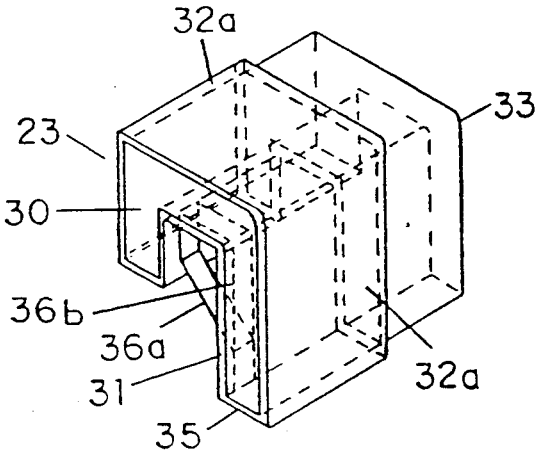
FIG. 6 is a perspective view of a slip-on fabric cover strap.

FIG. 6 illustrates an end strap (32*a*) also reversible, which is an adaptation of cover (32), which acts as a decorative piece to fit at the ends of the padded rail or any where along the padded rail-here shown on executive rail (23) but equally as applicable to regular rail (21)-to provide for a contrasting fabric or simply to provide for a cleaner fit or look. That is, FIG. 6 illustrates cover (32*a*) of a length generally between 2 inches and 8 inches provided for executive rail (23) (but equally adaptable to fit regular rail). These straps cover (lengthwise) only a small portion of the padded rail and may be used in conjunction with a full-length cover (32) or over the skin of the padded rail to provide contrasting colors or patterns and/or used at the ends of the padded rails to help provide for a clean fit and nice decorative touch.

Figure 7A:
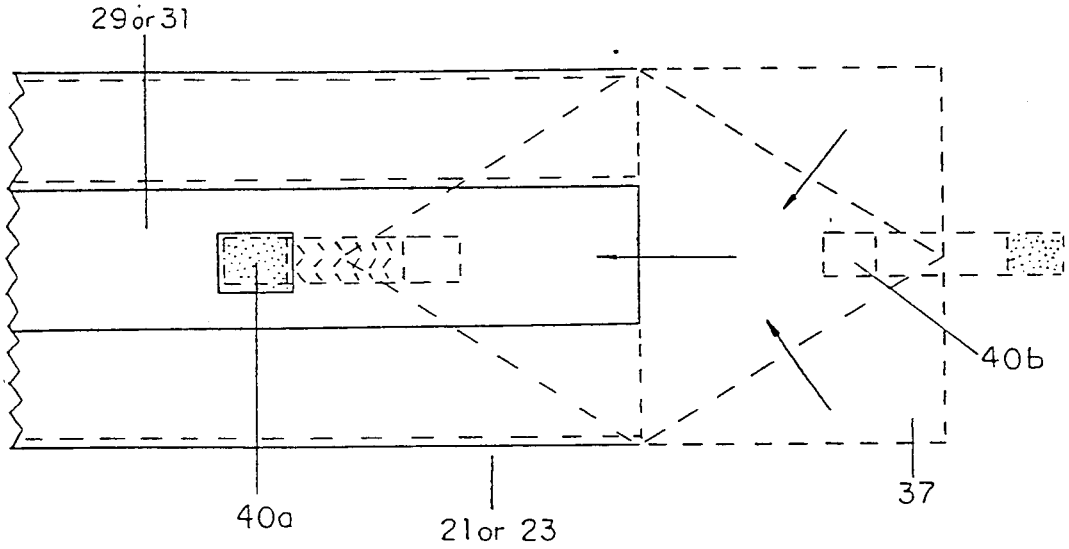
FIGS. 7*a* and 7*b* illustrate elevation views of a strip of elastic and the end of a rail cover added hold the ends snug against the padded rails.
Figure 7B:
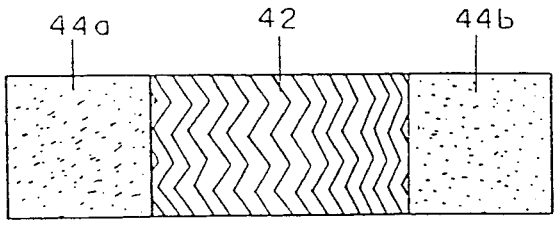

FIGS. 7*a* and 7*b* illustrate cover end (37) overlapping end of rail (21) or (23). Base (29) or (31) has a Velcro TM patch (40*a*), here the loop portion of the Velcro TM fastener system permanently attached. A second patch (40*b*) is sewn centrally to cover end (37). Elastic strap (42) having end portions (44*a*) and (44*b*) representing the hook portion of the Velcro TM fastener system is attached to, in stretched fashion, to (40*a*) and (40*b*) to hold the cover ends (37) snugly to the rail ends. By providing patch (40*a*) with adhesive backing, "one size fits all" in providing for a single length cover (32) which has elastically-held corners. If the length of cover is excessive, just place patch (40*a*) on base (29) or (31) where it will intercept stretched elastic band (42). The dashed lines of (37) and the arrows of FIG. 7*a* show how to fold cover end (37) to get a clean, flush, elastic tight fit.

Sheet (35) of cover (32) may have paired straps along the opposite edges thereof, which straps can be joined by a variety of means. FIGS. 8–13 illustrate a variety of different types of fastening means, including: Velcro ® (FIGS. 8 and 11), paired D-rings (FIG. 9), slip-fit fastener (FIG. 10), hook and loops (FIG. 12), and compression snap fits (FIG. 13). Regardless of the means of attaching the straps, the functional equivalent is the same as set forth as figures above-fastening the cover to the waterbed rail.

Figure 8:
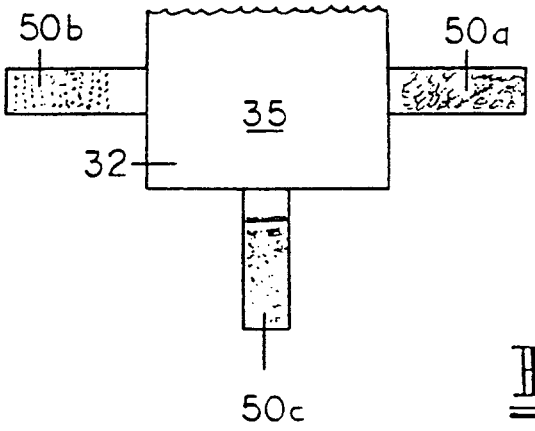
FIGS. 8–13 are elevational views of portions of cover (35) illustrating a variety of means of attaching the removed ends of paired straps disposed oppositely along opposite edges of the cover of applicant's invention.

Turning now to FIG. 8, it may be seen that cover (32) is comprised of sheet (35) having straps with hook and pile fasteners attached along opposite edges. That is, strap (50*a*) has pile on the surface thereof and is attached at a near end to the edge of cover (32). Opposite strap (50*a*) is a similarly dimensioned strap (50*b*) attached at a near end to the edge of cover (32). Straps (50*a*) and (50*b*) are attached when cover (32) is placed on waterbed rail. After cover (32) is placed on the waterbed rail with these straps attached, the rail is placed on the waterbed.

FIG. 8 also illustrates the use of strap (50*c*) along an end of cover (32) to allow the end to be folded under the padded rail and attached with strap (50*c*) to either a strap with a hook face to attach to the pile of strap (50*c*), or to a hook-type fastener attached to the underside of the waterbed rail itself.

Figure 9:
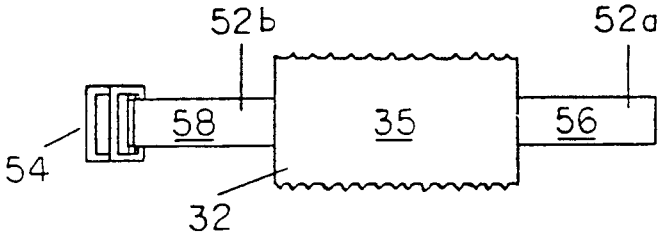

In the same manner as disclosed in FIG. 8 above, straps (52*a*) and (52*b*) of FIG. 9 may be attached at the removed ends thereof. Specifically, the removed end of strap (52*b*) is comprised of a pair of D-rings (54) that is connectable with a tension tightening fit to removed end of strap (52*a*) to hold cover (32) to the padded waterbed raft. Body (56) of strap (52*a*) and body (58) of strap (52*b*) may be comprised of either a nonelastic material such as cotton tape or the like, or one or both of bodies (56)/(58) may be made up of an elastic material.

Figure 10:
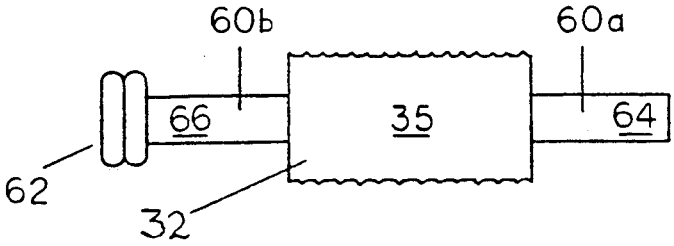

FIG. 10 illustrates the use of straps (60*a*) and (60*b*) as more specifically set forth in a manner similar to that set forth in FIGS. 8 and 9 above with the exception of slip-fit coupling means (62) which is engageable with the free end of strap (60*a*) to affix cover (32) to the padded rail. Likewise, bodies (64) and (66) of strap (60*a*) and (60*b*), respectively, may be either cotton tape or the like, or elastic.

Figure 11:
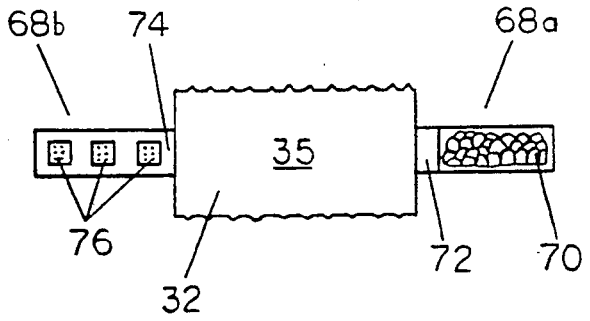

FIG. 11 illustrates straps (68*a*) and (68*b*) having Velcro ® hook and pile fasteners at or near their removed ends. Specifically, FIG. 11 illustrates cover (32) having straps (68*a*) and (68*b*) attached at near ends thereof along opposite edges of sheet (35). Pile portion (70) of strap (68*a*) can be removably attached to hook portions (76) on strap (68*b*) so as to affix cover (32) to the padded waterbed rail. Bodies (72) and (74) of straps (68*a*) and (68*b*), respectively, may be either cotton tape or the like, or elastic.

Figure 12:
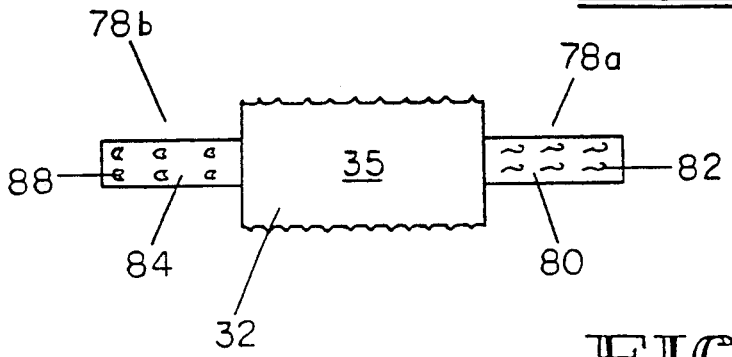
Figure 13:
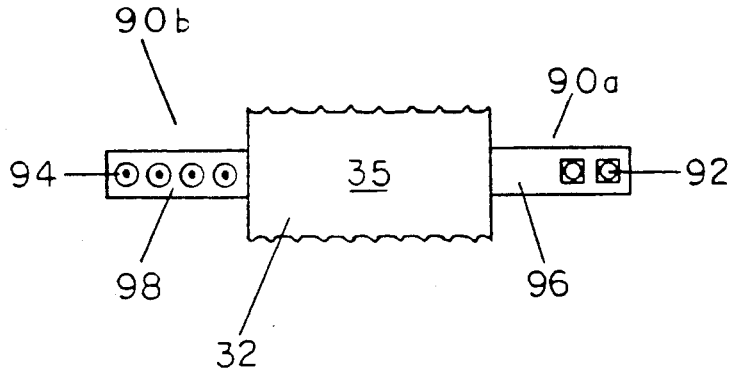

FIG. 12 illustrates yet another means of attaching the straps one to the other so as to affix cover (32) to the padded waterbed rail. Specifically, FIG. 12 illustrates straps (68*a*) having hooks (82) attached to the surface thereof. Hooks (82) engage loops (88) attached to the surface of strap (78*b*). Again, both straps are attached at their near ends along the opposite edges of sheet (35). Bodies (80) and (84) of straps (78*a*) and (78*b*) respectively may be either cotton tape or elastic.

FIG. 13 illustrates yet another means of fastening the straps so as to affix cover (32) to the waterbed rail. The straps are attached to sheet (35) as set forth above with FIGS, 8–12. However, straps (90*a*) and (90*b*) have female and male compression snap fit connectors attached to the surface thereof, respectively. Bodies (96) and (98), respectively, of straps (90*a*) and (90*b*) may be either cotton tape or the like, or elastic.

Figure 14:
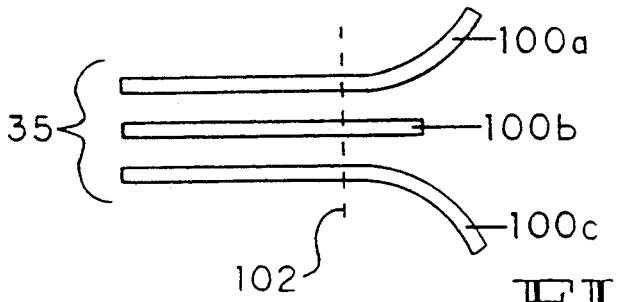
FIG. 14 is a side elevational view of a portion of the sheet of Applicant's cover showing a three-ply or three-member construction.

FIG. 14 illustrates sheet (35) of cover (32) having three plies or three separate members (100*a*), (100*b*) and (100*c*) that are sewn together at seam (102). The use of more than two members allows for a thicker, more durable cover (32) and prevents the pattern of the outer sheets, here (100*a*) and (100*c*), from coming through so as to be seen on the outer surface of cover (35). The use of a plain, dark color member (100*b*) between outer members (100*a*) and (100*c*) helps prevent this "see-through" effect which would mar the use of double-sided covers.

Terms such as "left", "right", "up", "down", "bottom", "top", "front", "back", "in""out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. In combination with a waterbed having a frame with a top edge, the frame for containing a water-filled mattress, and with removable padded rails for inserting on the edges:

a flexible cover or wrap, dimensioned to at least partially cover the padded rails, said cover or wrap with integral fastening means capable of removably securing said cover snugly to the outer surface of the padded rail when the same is inserted onto the top edge of the frame of the waterbed, wherein the fastening means comprises a multiplicity of paired straps, each of said paired straps comprising a first strap of hook fastening material and a second strap of loop fastening material oppositely disposed along opposite edges of said cover or wrap, said first and second straps capable of being removably joined one to the other.

2. The cover of claim 1 wherein said cover is between 6 feet to 8 feet long and 6 inches to 20 inches wide.

3. The cover of claim 1 wherein said cover is comprised of at least two similarly dimensioned fabric sheets sewn together at the perimeters thereof.

4. The cover of claim 3 wherein said at least two fabric sheets are dissimilarly decorated.

5. The cover of claim 1 wherein said first strap and said second strap are further comprised of elastic straps.

6. In combination with a waterbed having a frame with a top edge, the frame for containing a water-filled mattress, and with removable padded rails for inserting on the edges:

a flexible cover or wrap, dimensioned to at least partially cover the padded rails, said cover or wrap with integral fastening means capable of removably securing said cover snugly to the outer surface of the padded rail when the same is inserted onto the top edge of the frame of the waterbed, wherein said fastening means comprises a first strap with a pair of D-rings attached to a removed end thereof and a second strap having a removed end, the near end of both of said straps attached to said cover oppositely along opposing edges of said cover, the removed ends capable of being removably joined one to the other.

7. The cover of claim 6 wherein said cover is between 6 feet to 8 feet long and 6 inches to 20 inches wide.

8. The cover of claim 6 wherein said cover is comprised of at least two similarly dimensioned fabric sheets sewn together at the perimeters thereof.

9. The cover of claim 6 wherein said at least two fabric sheets are dissimilarly decorated.

10. In combination with a waterbed having a frame with a top edge, the frame for containing a water-filled mattress, and with removable padded rails for inserting on the edge:

a flexible cover or wrap, dimensioned to at least partially cover the padded rails, said cover or wrap with integral fastening means capable of removably securing said cover snugly to the outer surface of the padded rail when the same is inserted onto the top edge of the frame of the waterbed, wherein said fastening means comprises a first strap with a multiplicity of loops attached thereto and a second strap with a multiplicity of hooks attached thereon, the straps attached to said cover and oppositely disposed along opposing edges of said cover, the straps capable of being removably joined one to the other.

11. The cover of claim 10 wherein said cover is between 6 feet to 8 feet long and 6 inches to 20 inches wide.

12. The cover of claim 10 wherein said cover is comprised of at least two similarly dimensioned fabric sheets sewn together at the perimeters thereof.

13. The cover of claim 10 wherein said at least two fabric sheets are dissimilarly decorated.

14. In combination with a waterbed having a frame with a top edge, the frame for containing a water-filled mattress and with removable padded rails for inserting on the edges:

a flexible cover or wrap, dimensioned to at least partially cover the padded rails, said cover or wrap with integral fastening means capable of removably securing said cover snugly to the outer surface of the padded rail when the same is inserted onto the top edge of the frame the waterbed, wherein said fastening means comprises a first strap with a multiplicity of female compression snap connections thereon and a second strap with a multiplicity of male compression snap connections thereon, the straps attached to said cover and oppositely disposed along opposing edges of said cover, the straps capable of being removably Joined one to the other.

15. The cover of claim 14 wherein said cover is between 6 feet to 8 feet long and 6 inches to 20 inches wide.

16. The cover of claim 14 wherein said cover is comprised of at least two similarly dimensioned fabric sheets sewn together at the perimeters thereof.

17. The cover of claim 14 wherein said at least two fabric sheets are dissimilarly decorated.

18. In combination with a waterbed having a frame with a top edge, the frame for containing a water-filled mattress, and with removable padded rails for inserting on the edges:

a flexible cover or wrap, dimensioned to at least partially cover the padded rails, said cover or wrap with integral fastening means capable of removably securing said cover snugly to the outer surface the padded rail when the same is inserted onto the top edge of the frame of the waterbed, wherein said fastening means comprises a first strap having a near end and a removed end, the removed end having a coupling means thereon and a second strap having a near end and a removed end, the removed end for removably attaching to the coupling means of said first strap, the straps attached to said cover and oppositely disposed along opposite edges of said cover, the straps capable of being removably joined one to the other.

* * * * *